US005558468A

United States Patent [19]

Barnett, Jr. et al.

[11] Patent Number: 5,558,468

[45] Date of Patent: Sep. 24, 1996

[54] METHOD AND APPARATUS FOR ERECTING A MARINE STRUCTURE

[75] Inventors: Andrew C. Barnett, Jr., 1013 River Bend Dr., Houston, Tex. 77063-1503; Larry R. Russell; Barbara L. Thompson, both of Houston, Tex.

[73] Assignee: Andrew C. Barnett, Jr., Houston, Tex.

[21] Appl. No.: 276,107

[22] Filed: Jul. 15, 1994

[51] Int. Cl.[6] ..... E02D 25/00; B63B 35/44

[52] U.S. Cl. ..... 405/204; 114/259; 414/139.6; 405/209

[58] Field of Search ..... 405/203, 204, 405/209; 114/258, 259; 414/139.4, 139.6, 139.8, 140.1

[56] References Cited

U.S. PATENT DOCUMENTS

| | | | |
|---|---|---|---|
| H488 | 7/1988 | Rowan | 405/209 |
| 4,252,469 | 2/1981 | Blight et al. | 405/204 |
| 4,729,695 | 3/1988 | Silvestri | 405/204 |
| 4,826,355 | 5/1989 | Marion | 405/204 X |
| 4,930,938 | 6/1990 | Rawstrum et al. | 405/204 |

FOREIGN PATENT DOCUMENTS

| | | | |
|---|---|---|---|
| 1577619 | 10/1980 | United Kingdom | 405/204 |

*Primary Examiner*—David J. Bagnell

*Attorney, Agent, or Firm*—Pravel, Hewitt, Kimball & Krieger

[57] ABSTRACT

The deck or superstructure for an offshore production platform is shifted from a loading facility onto a cargo vessel that includes a large-area lifting assembly. The vessel transports the superstructure to a previously-installed substructure. On site, the elevator assembly raises the superstructure above the top of the substructure jacket, aligns the superstructure with the substructure and then mates the two together by lowering the elevator assembly. The elevator assembly is designed to break away very rapidly from the superstructure to compensate for vessel rebound when the mass of the superstructure is accepted by the substructure.

12 Claims, 7 Drawing Sheets

METHOD AND APPARATUS FOR ERECTING A MARINE STRUCTURE

BACKGROUND OF THE INVENTION

1. Field of the Invention

A method and apparatus for transporting and mating a superstructure to a substructure jacket that was previously secured to the water bottom at a desired location in a body of water. The superstructure is moved into place on an adjustable-draft cargo vessel. Once in position, a plurality of fast-acting lifting and lowering devices mounted on the cargo vessel, deposit the superstructure in place on the substructure.

2. Discussion of Related Art

In the erection of large structures in a body of water, it is not uncommon for the builder to make all or part of the structure ashore and then to transport the structure to location aboard a cargo vessel such as a barge or ship having adjustable draft capability. For example, the center span of a bridge may be floated into position on a vessel. The span is mounted on a trestle constructed over the deck of the transport vessel so that the span lies well above the fixed anchoring points to which opposite ends of the bridge span will be fastened. On location, the vessel is ballasted to sink until the span is deposited in place over the anchoring points. Alternatively, tidal motion may be used in place of, or in addition to, vessel draft-adjustment by use of ballast-tank flooding.

That method has been extended to construction of offshore platforms that are used for oil exploration and production. For example, U.S. Pat. No. 4,252,469, issued to G. J. Blight et al, on Feb. 24, 1981 describes a "Method and Apparatus for Installation of Integrated Deck Structure and Rapidly Separating Same from Supporting Barge Means". According to the Abstract, an apparatus is taught that provides lateral force-transmitting arch means extending across a vessel passageway which is laterally bounded by upwardly projecting portions of a substructure and bounded on the top by an integrated deck. The means for assembling the deck and the substructure include horizontal and vertical shock-absorbing and damping means as well as alignment means. Means are provided for lowering the deck to the substructure at a first relatively slow rate and then separating the deck from the vessel at a subsequent faster lowering rate.

U.S. Pat. No. 4,729,695, issued Mar. 8, 1988 to Antonio Silvestri, discloses a method entitled: "A Process for the Installation of the Enbloc Superstructure of an Offshore Platform and Equipment for Carrying It Out Practically." The patent discloses a method for installing the deck of an offshore platform to the fixed legs emerging from the water of the lower structure or jacket including loading the whole superstructure on a vertically movable support platform provided on the deck of a semisubmersible raft or barge, completely submerging the raft in the vicinity of the jacket, the stability being maintained by vertical buoyancy tanks on the raft deck, and lifting the support platform above the protruding ends of the jacket legs independently from wave motion from the sea. Subsequently, lift pillars slide, by means of hydropneumatic jacks, within tubular columns provided in the superstructure until the conical ends of the pillars enter corresponding seats in the jacket legs, and, during a moment of smooth seas, the superstructure is lifted to the desired height using the hydropneumatic jacks while at the same time the support platform is lowered and the raft is ballasted.

U.S. Pat. No. 4,930,938, issued Jun. 5, 1990 to P. J. M. Rawstrom et al. teaches an "Offshore Platform Deck/Jacket Mating System and Method." This is a system for mating a preconstructed barge-mounted deck with a previously installed offshore jacket. The system includes at least two primary load transfer units, at least one secondary load transfer unit and a plurality of drop block assemblies. The primary load transfer units are designed to absorb a portion of the weight of the integrated deck as the integrated deck is lowered onto the jacket. The secondary load transfer units are designed to engage after a portion of the weight of the integrated deck has been absorbed by the primary load transfer unit and to assist the primary load transfer units in absorbing an additional portion of the weight of the deck as it continues to be lowered onto the jacket. The drop block assemblies are designed to rapidly disengage the deck from any contact with the unloaded deck supports that remain on the barge.

Certain problems afflict presently-known offshore deck-installation techniques. Typically, the superstructure must be moved from the place of manufacture to a wharf where it is loaded onto a vessel. Loading may be accomplished by means of a crane, an awkward process that adds expense and introduces complications if, indeed, a crane of adequate lifting capacity can be found. Often, larger structures are skidded onto the vessel. Transportation of the integrated deck or superstructure requires use of supporting trestles which complicate construction of the superstructure itself. The consequent relatively higher center of gravity contributes to instability of the transporting vessel. The known methods for disconnecting the deck from the vessel do not adequately take into consideration the abrupt decrease of the draft of the vessel and the consequent increase in freeboard when the mass represented by the superstructure is fully transferred from the vessel to the jacket legs. In some instances, the vessel is ballasted while transfer is taking place but the ballast-water inflow rate has been found to be too slow to be effective. The drop block assembly of the '938 patent provides rapid disconnection but the assemblies are subject to severe stresses that are conducive to mechanical failure of the system.

There is a need for a simple means for loading a superstructure, such as the integrated deck of an offshore platform, onto a cargo vessel such that the load presents a low profile and center of gravity. Jacking means are needed to lift the superstructure into place over the previously installed jacket. It is particularly important that a rapid, controlled breakaway action be provided to compensate for vessel rebound due to an abrupt decrease in vessel draft when the mass of the superstructure is suddenly transferred from the vessel to the preinstalled jacket. After breakaway, the clearance between the superstructure and the vessel must be sufficient to prevent subsequent impactive damage due to sea-swell-induced vessel heave.

SUMMARY OF THE INVENTION

This invention provides a method and apparatus for emplacing a structure in a body of water. The method includes first fastening a substructure to the water bottom at a desired location. A loading facility is provided for receiving a shore-built superstructure and for skidding the superstructure onto an elevator assembly integrated into the deck of a variable-draft cargo vessel. The superstructure is coupled to the elevator assembly for transport to the location proximate the substructure. The elevator assembly raises the superstructure above and into alignment with the substructure whereupon the superstructure is lowered to mate with the substructure and is then uncoupled from the elevator assembly and is lowered to mate with the substructure. The elevator assembly includes a mechanically-powered rapid breakaway action which is actuated to cause transfer of the superstructure mass to the substructure.

BRIEF DESCRIPTION OF THE DRAWINGS

The novel features which are believed to be characteristic of the invention, both as to organization and methods of operation, together with the objects and advantages thereof, will be better understood from the following detailed description and the drawings wherein the invention is illustrated by way of example for the purpose of illustration and description only and are not intended as a definition of the limits of the invention.

DETAILED DESCRIPTION OF THE PREFERRED EMBODIMENT

Figure 1:
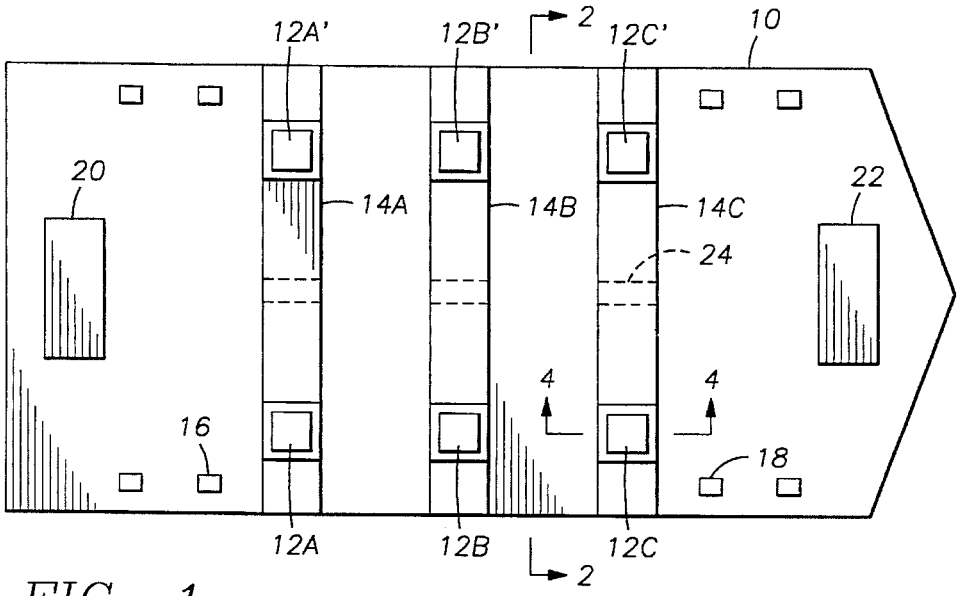
FIG. 1 is a plan view of the cargo vessel of this invention showing the configuration of the elevator assembly components.

FIG. 1 is a plan view of a cargo vessel 10 such as an ocean-going barge by way of example but not by way of limitation. Typical exemplary dimensions are 750 feet long, 185 feet wide and about 50 feet from deck to keel. Unloaded, the vessel draws about eight feet of water, displacing about 35,000 tons thereof. The hull of the vessel may include a plurality of separately floodable ballast tanks. The carrying capacity of the vessel is on the order of 50,000 tons, exclusive of the ballast water needed to maintain vessel stability in the face of the unsymmetrical loading typical of offshore drilling and production platforms A plurality of lifting means such as 12A, 12B, 12C, etc. are distributed at regular intervals in an areal pattern over the open deck of the vessel. The lifting means may be of any desired type such as hydraulic cylinders, rack-and-pinion jacks, ball screws or any other well-known means for lifting heavy loads. By way of example but not by way of limitation, the lifting means will be shown as double-acting hydraulic pistons which will be disclosed more fully in connection with FIG. 4. A plurality of, such as six, lifting means are shown distributed in a linear array in two perpendicular directions in an areal pattern but more or fewer may be included in the pattern as needed to accommodate anticipated loads. Taken as a whole, the plurality of lifting means, acting in unison, form an elevator assembly.

A number of skidways 14A, 14B, 14C are provided for receiving an extended-area load such as the deck superstructure of an offshore oil production platform. Three skidways are shown in a transverse configuration but more may be employed if desired. The skidways may be transverse as shown or they may be longitudinally disposed parallel to the fore-and-aft axis of the vessel. Of course, in an alternative configuration, both skidway arrangements could be concurrently installed on the same vessel.

It is to be observed that the individual lifting means such as 12A, 12B, 12C of the elevator assembly are nested in the skidways. Each skidway 14A, 14B and 14C typically may include at least two such lifting means 12A and 12A', 12B and 12B', 12C and 12 C', which are shown in FIG. 1 to be transversely disposed in pairs. In particular, if the third configuration is used, the lifting means are positioned at the skidway intersections. The dimensions of the skidways may be on the order of 8 feet high, 8 feet wide and extending, in the case of the Figures, completely across the beam of the vessel 10.

Additional deck-mounted equipment on the vessel 10 includes but is not limited to winches (represented as small squares) such as stern winch 16 and bow winch 18, an engine room 20 for providing hydraulic power and pump room 22 for housing ballast pumps (not shown) for ballasting and deballasting the vessel. Because of the great size of the skidways, access tunnels or throughways such as 24 may be provided midships, shown as dashed lines in FIG. 1.

Figure 2:
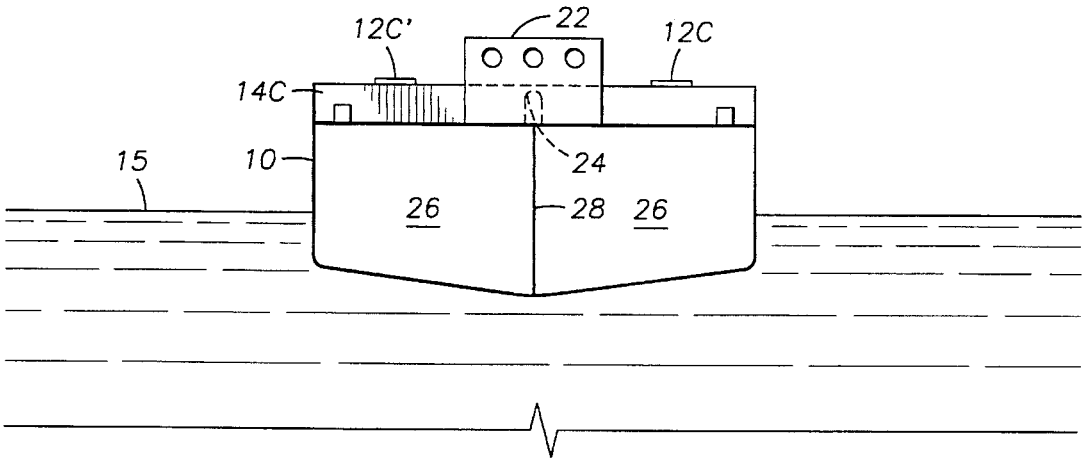
FIG. 2 is a cross sectional view of the cargo vessel of FIG. 1 along line 2—2.

FIG. 2 is a cross sectional view looking forward, just behind skidway 14C along line 2—2, showing the vessel floating in a body of water 15. The piston end caps of individual lifting components 12C and 12C' are shown projecting slightly above the top of skidway 14C but the details of the hydraulic piston assembly are hidden by transverse bulkhead 26 which forms part of the skidway structure. A longitudinal bulkhead 28 is provided. In accordance with known barge design, vessel 10 may be divided into many compartments (not shown) as previously stated for selective ballasting to maintain stable trim. Other details in FIG. 2 include a view of the top of control room 22 having observation port holes as well as the entrance to passageway 24.

Figure 3:
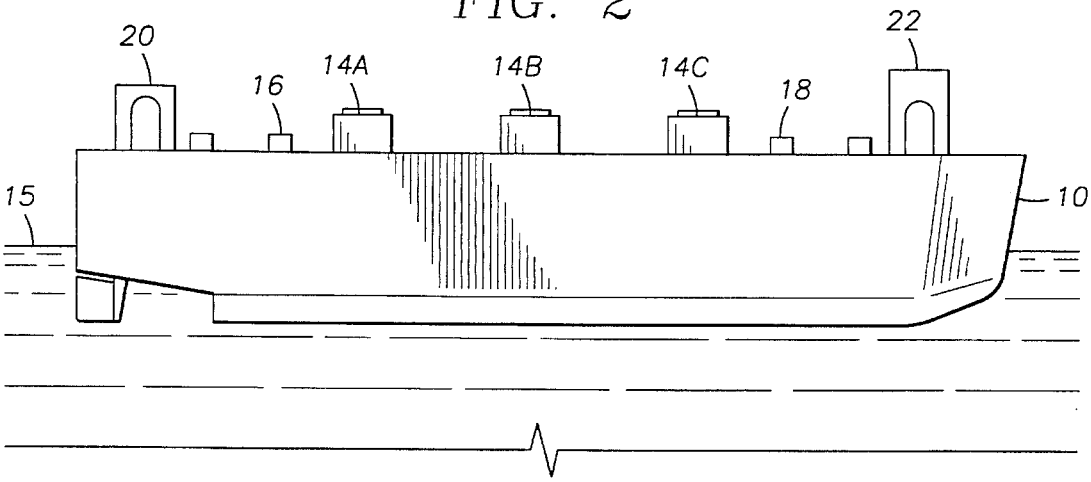
FIG. 3 is a side view of the vessel of FIG. 1 as seen from line 3—3.

FIG. 3 is a side view of the vessel 10 as seen from a line 3—3. The details of the structures were described in connection with FIGS. 1 and 2. No further description is needed.

Figure 4:
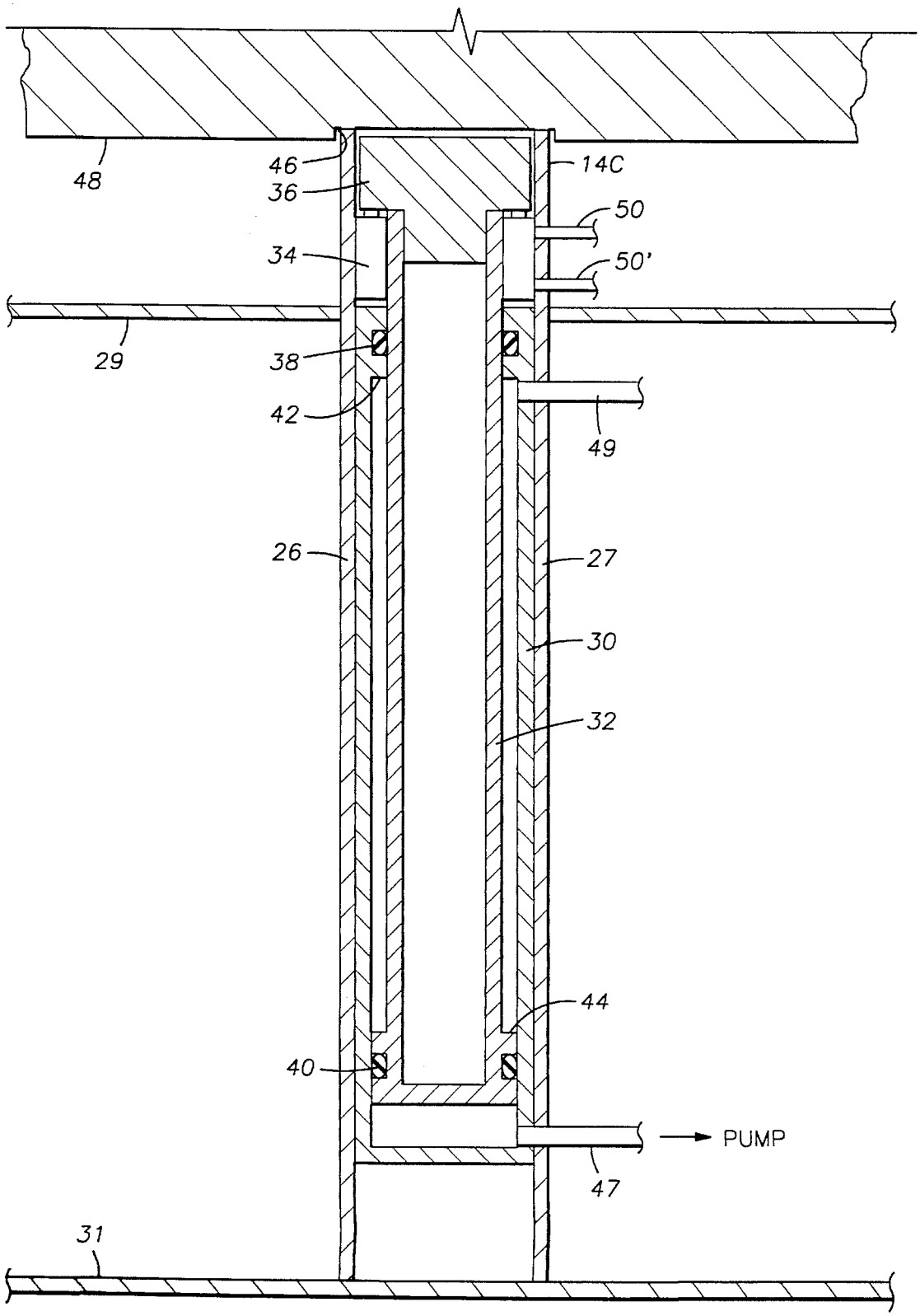
FIG. 4 is a cross sectional view along line 4—4 of a typical hydraulic lifting means.

FIG. 4 is a cross section along line 4—4 of FIG. 1, showing the details of construction of a typical lifting means such as 12C, shown in the retracted position. Lifting means 12C is installed between two transverse bulkheads 26 and 27 which form the foundations for skidway 14C. Bulkheads 26 and 27 extend from the deck 29 of the vessel to keel 31. Lifting means 12C consists essentially of a cylinder body 30, heavy-wall hollow piston rod 32, hydraulic squeeze bushing 34, rod end cap 36 and suitable pressure seals 38 and 40. A alternate device to a squeeze bushing might be powered pipe slips as used in borehole drills. Additional components such as an upper rod bearing, rod scraper and other design details known to those skilled in the art are assumed to be present but are not shown as not being germane to this invention. The upper portion of cylinder body 30 includes an upset portion 42 to form a gland end that serves to limit the upward travel of piston rod 32 when contacted by shoulder 44 on the lower end of rod 32.

The inner diameter of cylinder 30 is on the order of 96 inches and the rod diameter is 88 inches. The stroke of the hydraulic piston is on the order of 30 feet. The fluid capacity of the piston side is about 11,300 gallons and on the rod side, about 1800 gallons. Fluid ports 47 and 49 are provided for the piston and rod sides of lifting means 12C. Port 50 is provided to admit fluid to a squeeze bushing 34, such as is made by Advanced Machine and Engineering Co., that is used to lock piston rod 32 in any desired axial position. In use, end cap 36 of lifting means 12C engages a lifting pad or seat 46 built into the base of the load (shown conceptually as 48) that is to be transported by the vessel. The details shown in FIG. 4 are typical of all of the respective remaining lifting means.

Figure 5:
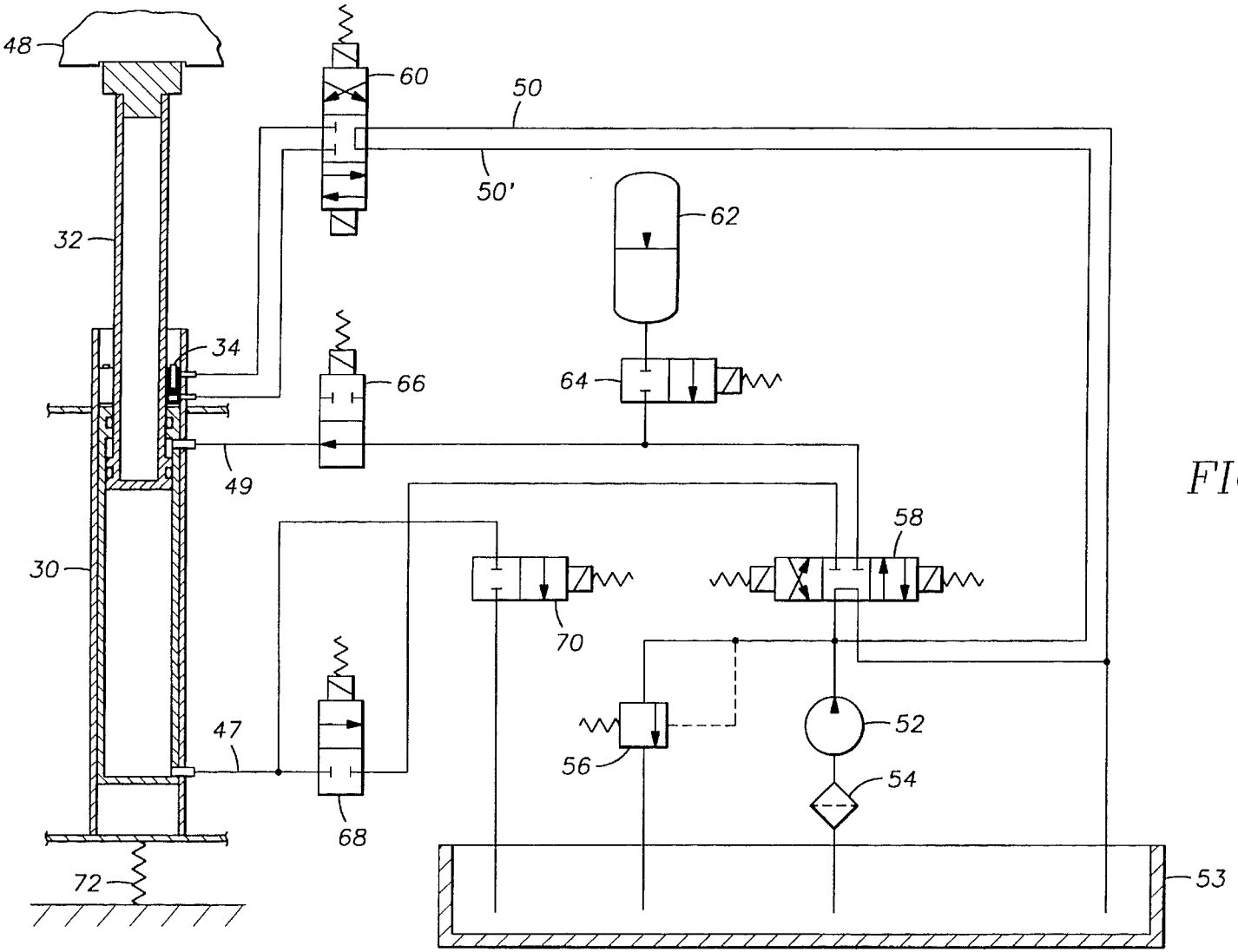
FIG. 5 is a preferred design for a hydraulic control system for operating the hydraulic lifting means.

FIG. 5 represents a typical hydraulic control circuit for operating a hydraulic lifting means such as 12C, shown in the extended position. It is envisioned that each set or subplurality of no more than two lifting means such as 12C and 12C' will be serviced by one control circuit. Thus, in the case of six lifting units, there will be three separate hydraulic control circuits. That arrangement is required because of unequal mass distribution of the loads to be lifted. For example, the required pressure of the pump that powers cylinder 12C might be substantially different from the displacement needed for the pump that powers cylinder 12A because of a grossly different mass loadings.

Pump 52 draws fluid from tank 53 through strainer 54. A pressure relief valve 56 limits the maximum pump side pressure which is on the order of 2200 pounds per square inch. Pump output is divided between two parallel-coupled double-solenoid-operated spring-centered 3-position 4-way valves 58 and 60 with free return to tank 53 and with the output ports blocked in the center position. Valve 58 controls the extension and retraction of piston 32 of a double-acting lifting means such as 12C. The input line to the rod-side input port 49, from a first output line of valve 58, is teed to an accumulator 62 through a solenoid-actuated spring returned 2-position 2-way accumulator isolation valve 64. Solenoid-operated spring-returned 2-position 2-way lock valve 66 is in series with port 49 and the output of pump 52. The other output line from valve 58 leads to piston-side port 47 through lock valve 68 having the same configuration as valves 64 and 66. During a retraction cycle, fluid is exhausted to tank 53 from the piston side port 47 through a high-capacity dump valve 70 or through several such valves if needed. Dump valve 70 may be a solenoid-operated valve of the same type as valves 64 and 66 or it may be a large-diameter, electrically-controlled ball valve or alternatively a gate valve. Valve 60 actuates the squeeze bushing 34 to lock piston 32 in a desired position in the case of a hydraulic failure or failure of lock valve 68.

In operation, from the normal retracted position of piston 32, as in FIG. 4, the load, that is, a superstructure, is elevated by actuation of the elevator assembly consisting of the plurality of lifting means operating in unison. Valves 58 and 68 are opened to allow fluid flow from pump 52, through valve 68 to piston side port 47 thereby to displace piston 32 upwards. Valve 66 is opened to vent the rod-side chamber to tank through port 49. When the piston is fully extended, valves 66 and 68 are closed and valve 60 is operated to cause squeeze bushing 34 to embrace piston rod 32 to prevent axial movement. Thereafter, the superstructure is transferred to and installed on an underwater jacket as will be explained later. During that operation, accumulator isolation valve is opened to charge accumulator 62. Valve 58 may then be returned to the center position.

The vessel may be raised for transfer of the superstructure to the jacket by de-ballasting the vessel so that it rides higher in the water. However, when the superstructure is to be transferred to the jacket, elevation is done entirely by the elevator assembly. During the time that the superstructure is transferred to the jacket, the vessel rebounds due to a sudden decrease in loading of the de-ballasted vessel when the mass of the load is being accepted by the jacket. During this time, the superstructure and the jacket are subject to damage due to erratic sideways loadings due to wave action.

The rebound in combination with vessel heave is represented by the symbolic spring 72 at the bottom of the cylinder 30. The vessel must decouple itself to rapidly break away the elevator assembly from the now-installed superstructure. If that is not done, impactive damage to the elevator assembly or to the vessel itself may ensue due to sea-swell-induced vessel heave. From a practical standpoint, it turns out that a break-away operation using merely conventional re-ballasting of the vessel by pumping in water is far too slow, requiring a delay on the order of hours. The term "rapid breakaway" is defined as the act of retracting the piston 32 within one minute or less. Retraction must be done in a controlled manner by coordinating the action of the respective cylinders so that they retract uniformly.

For rapid piston retraction, lock valve 68 remains closed, squeeze bushing 34 is released, lock valve 66 and accumulator isolation valve 64 are opened. Upon opening of dump valve 70, the pressurized fluid from accumulator 62 acting against shoulder 44 (FIG. 4) of piston 32 forces the piston to abruptly retract in power-assisted free fall. Rapid breakaway and retraction of the elevator assembly requires a fluid flow rate through dump valve 70 of up to 22,600 gallons per minute per piston which is preferably accomplished by use of a ball valve on the order of eight inches aperture as previously discussed.

Because of the high flow rates needed for high-speed breakaway, as explained earlier it is preferable that a single hydraulic control valve system would service no more than two hydraulic cylinders. However, all of the individual hydraulic control valve systems are synchronized electrically in a manner well known to the art. Preferably the electrical interlock system includes a manual override for operator intervention if required. Operating controls are housed in control room 20 at the stern of the vessel or they optionally could be housed in pump room 22 at the forward end of the vessel 10.

Figure 6:
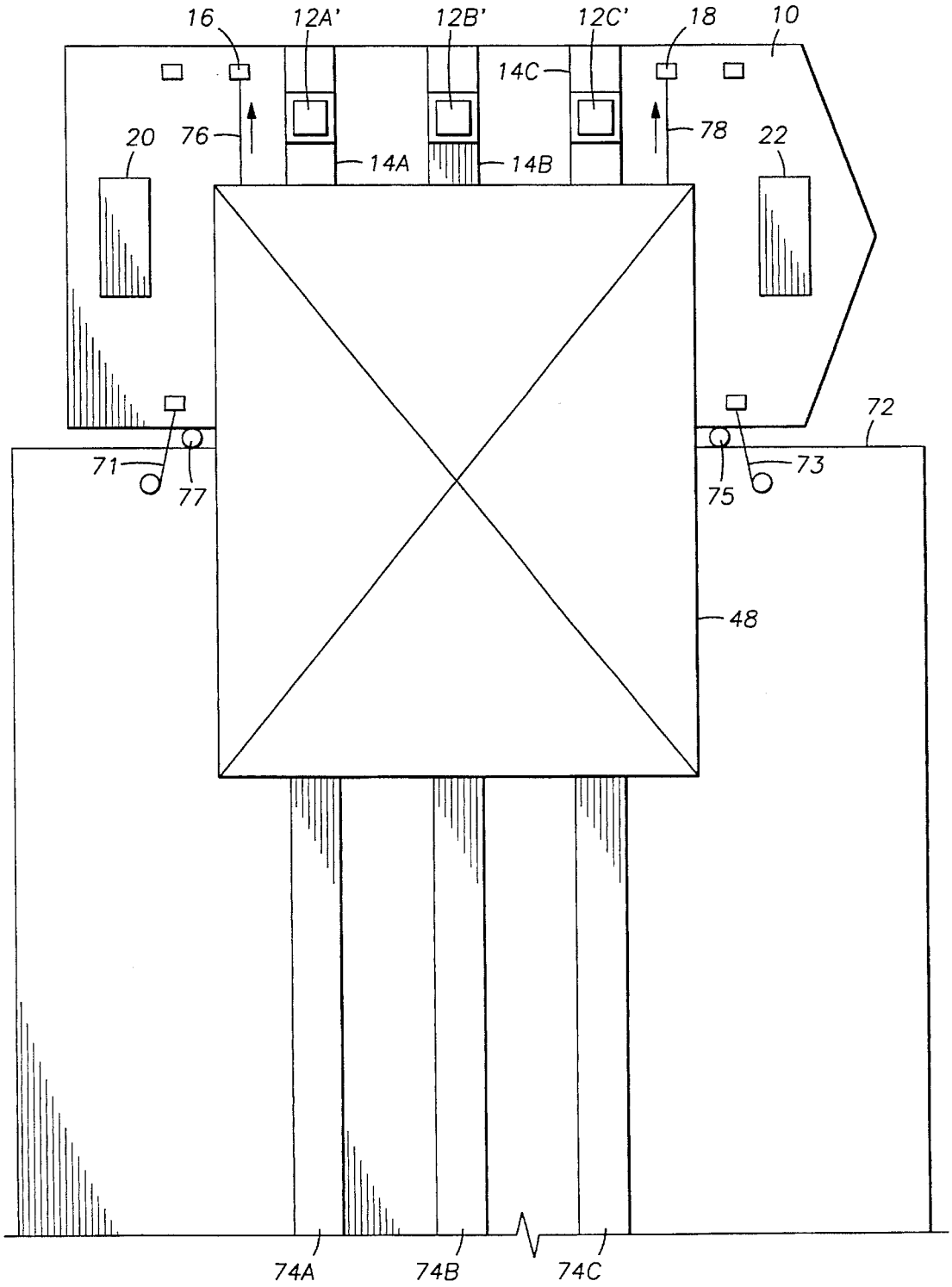
FIG. 6 is a plan view of the vessel docked at a wharf for receiving an extended-area load.

The best mode of operation is illustrated in the following FIGS. 6–11. With reference to FIG. 6, a deck superstructure 48 for an offshore oil-drilling platform has been constructed at a shore-based manufacturing facility and has been moved to a wharf or loading facility 72. Wharf 72 includes parallel-disposed shore-mounted skid tracks 74A, 74B, 74C. Vessel 10 is moored adjacent wharf 72 by mooring lines 71 and 73, protected by fenders 75 and 77. The position and draft of the vessel are adjusted so that the shore-mounted skid tracks and the deck-mounted skidways are aligned with each other. Superstructure 48 is skidded into place by winching it from wharf 72 to vessel 10 using lines 76 and 78 attached to winches 16 and 18 through suitable snatch blocks or other rigging. During the loading operation, the draft of the vessel must be continuously adjusted by the ballast pumps as the mass of the superstructure is slowly shifted from wharf to vessel.

Figure 7:
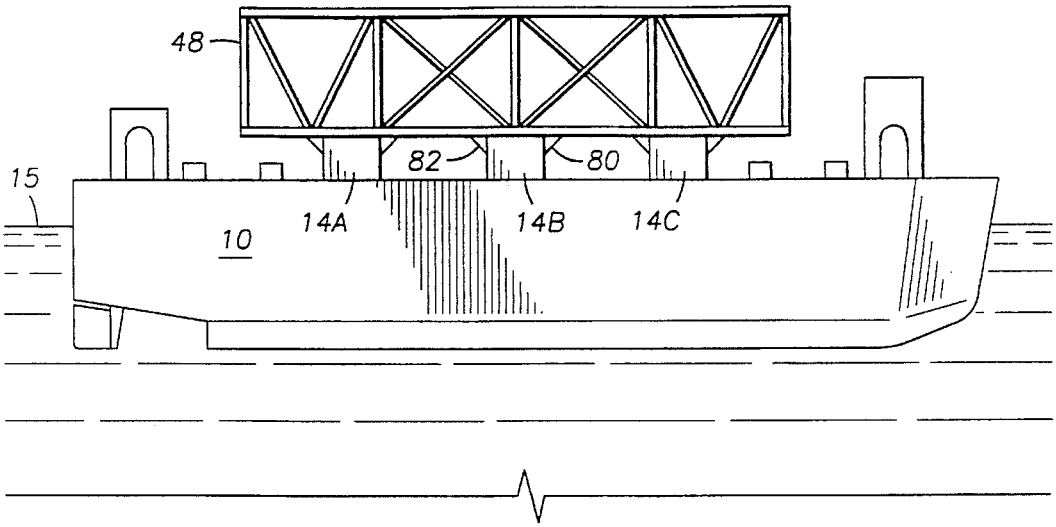
FIG. 7 shows the vessel in side view with a superstructure skidded in place, fastened to the skidways.

FIG. 7 is a side view of the vessel with superstructure 48 loaded thereon. For transport to a substructure jacket located far at sea, superstructure 48 is fastened down to each of skidways 14A, 14B, 14C by any convenient tie-down means such as 80 and 82 such as by welding, load binders or other well known means. The elevator assembly is fully retracted. Vessel 10 is ballasted such that it rides high enough to prevent the load from being submerged in high seas.

Figure 8:
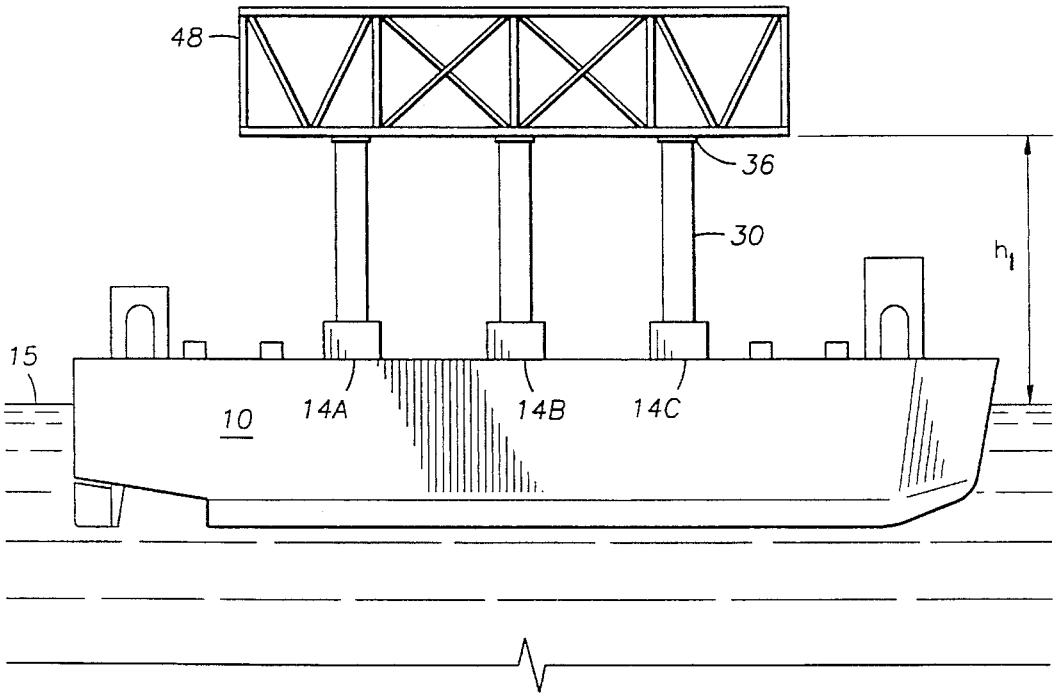
FIG. 8 shows the superstructure elevated above the cargo vessel preparatory to installation on an offshore substructure.

Upon arrival at the site of the jacket installation as in FIG. 8, the load 48 is elevated to the raised position preparatory to installation after it has been unfastened from the respective skidways. The total required height $h_1$ is the sum of the height of the offshore jacket legs above the water, the specific heave of the vessel in the face of expected sea conditions, and the vertical clearance required between the bottom of the superstructure and the top of the jacket legs.

Figure 9:
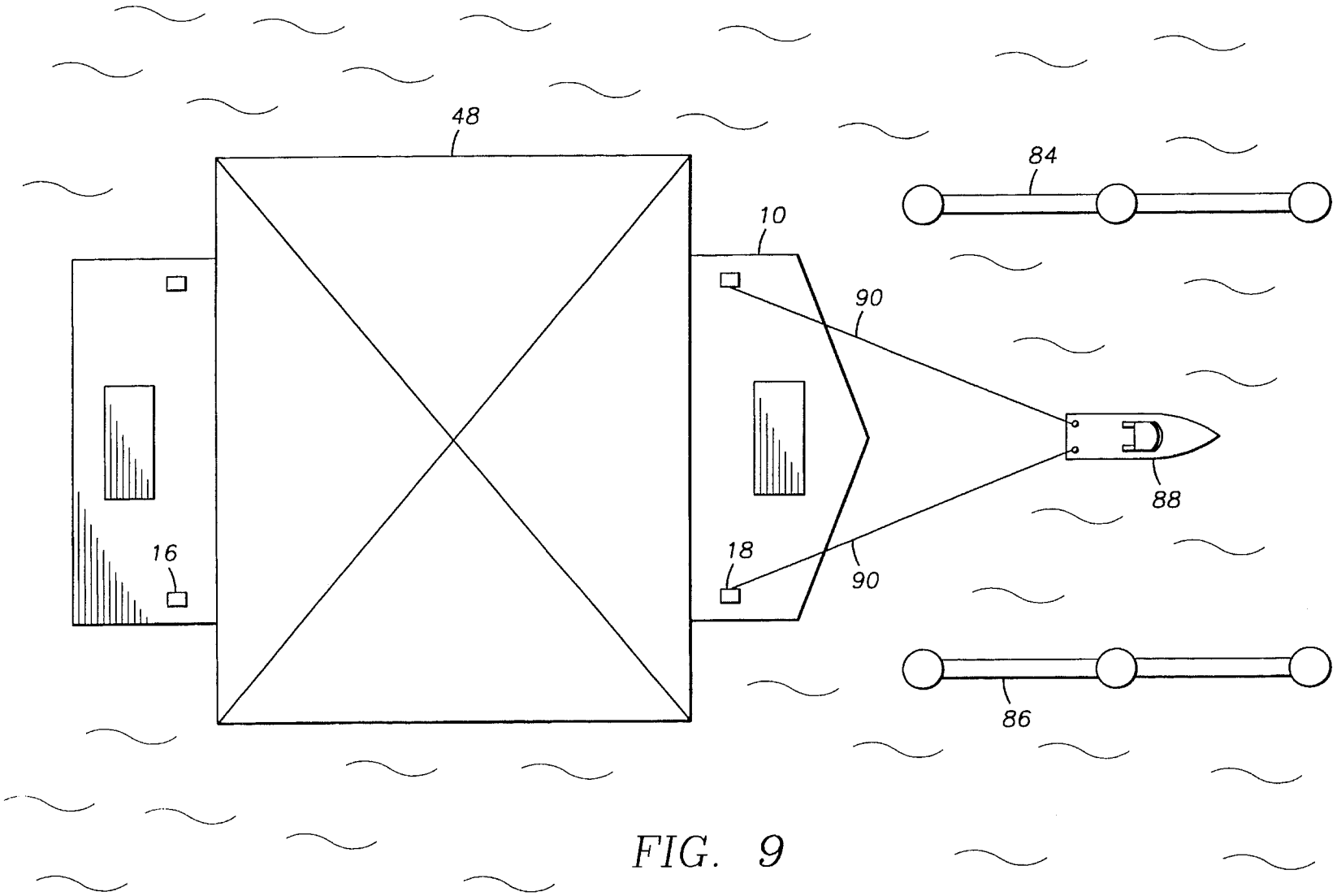
FIG. 9 illustrates the vessel being moved into position.

FIG. 9 is a plan view of an exemplary offshore jacket, the above-water exposed portion of which consists of two rows of interconnected leg extensions 84 and 86. With the superstructure 48 raised as in FIG. 8, tugboat 88 tows vessel 10 by tow lines 90, in place between the legs as shown by the arrow pointing to the right.

Figure 10:
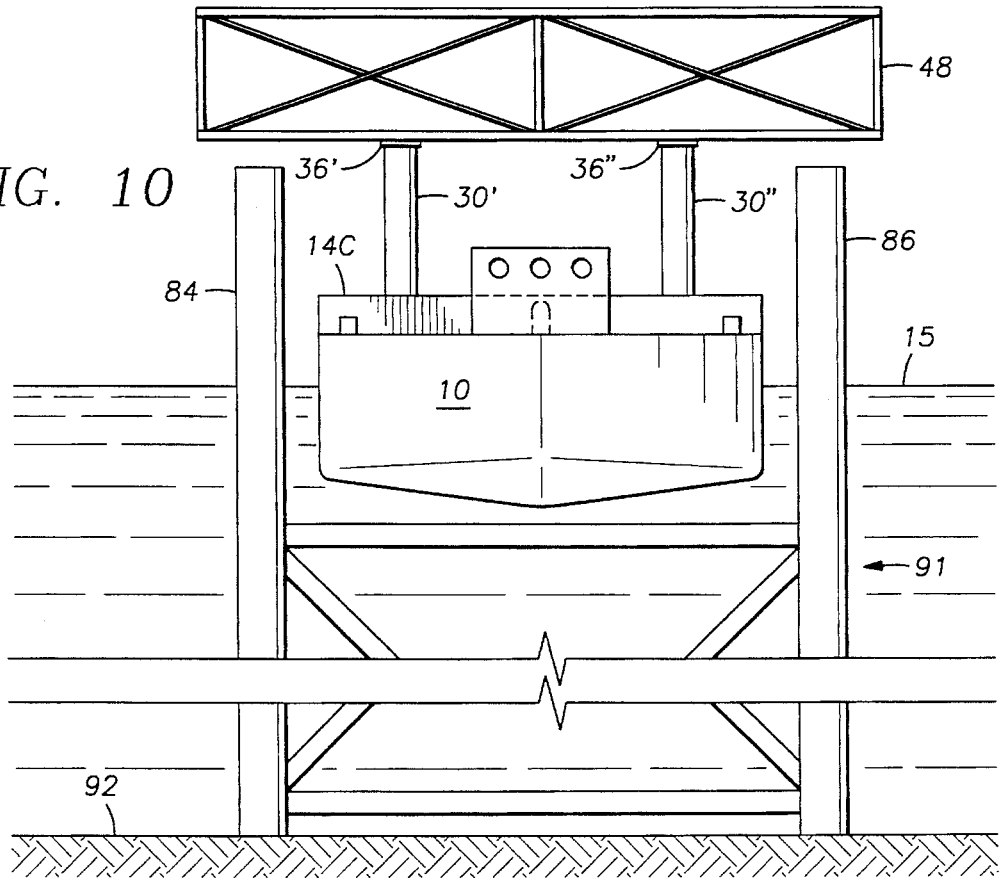
FIG. 10 is an end view from the stern of the vessel looking forward after having moved into position between the risers of the substructure.

FIG. 10 is an end view looking forward from the stern of vessel 10 after the vessel has been moved into place between leg extensions 84 and 86 which form the above-water part of the jacket generally shown as 91 which is fastened to the sea floor 92.

Figure 11:
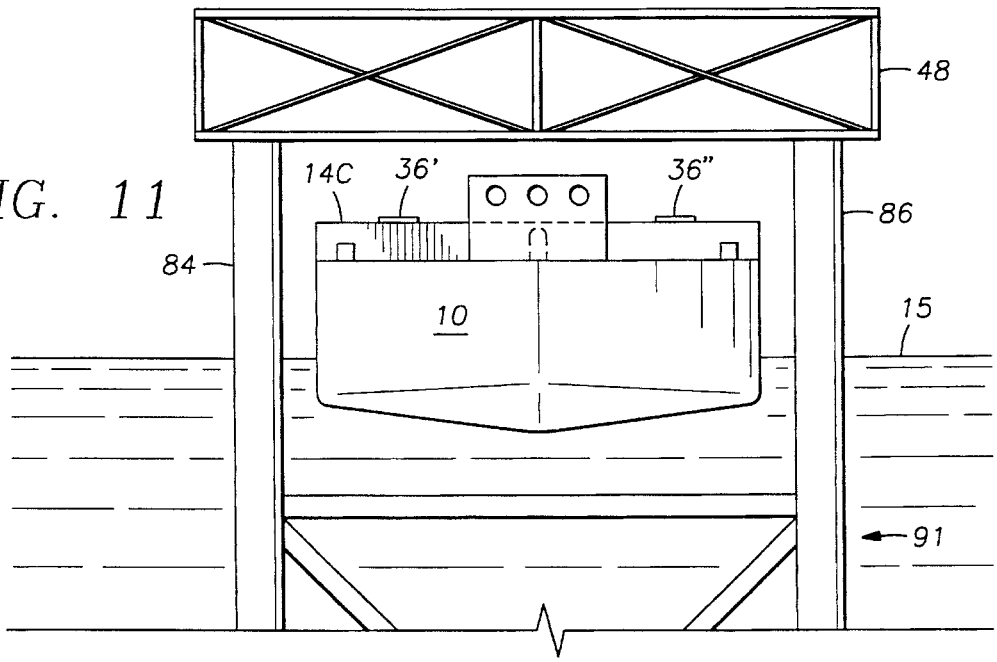
FIG. 11 shows the elevator assembly retracted following transfer of the mass of the superstructure from the vessel to the substructure and post-transfer rebound of the vessel.

In FIG. 11, the superstructure 48 has been successfully transferred to jacket 91, the elevator assembly has broken away from the superstructure and the vessel, now relieved of its load, has rebounded perhaps 12 feet higher in the water. Vessel 10 is then removed from between the legs of the jacket 91 and returns to its base.

This invention has been described with a certain degree of specificity. The examples cited herein should in no way be taken as limiting. Those skilled in the art will conceive of variations in the above teachings but which will lie within the scope of this disclosure which is limited only by the appended claims.

What is claimed is:

1. A method for installing a superstructure onto a substructure jacket located offshore to form an offshore platform, with the superstructure initially at a wharf and the substructure jacket supported offshore on a sea bottom at a location remote from the superstructure initially and the substructure jacket having a plurality of leg extensions extending above the sea surface, the method comprising the steps of:

erecting a plurality of parallel-disposed shore-mounted skid tracks on the wharf;

providing a variable-draft cargo vessel having a deck and a plurality of parallel-disposed deck-mounted skidways, each said skidway having a top surface;

nesting a plurality of normally retracted lifting means within each of said skidways and below said skidway top surface;

docking said cargo vessel at the wharf so that said deck-mounted skidways are in alignment with said shore-mounted skid tracks;

skidding the superstructure along said shore-mounted skid tracks and thence on to said deck-mounted skidways;

fastening the superstructure to said cargo vessel;

transporting said cargo vessel with the superstructure thereon to a location offshore in proximity to the substructure jacket supported on the sea bottom;

unfastening the superstructure from said cargo vessel;

extending said plurality of lifting means nested in each said skidway upwardly to elevate the superstructure to a preselected height above the jacket leg extensions;

depositing the superstructure in mating relationship upon the jacket while rapidly retracting said lifting means away from the superstructure with a coordinated movement of the lifting means to provide a rapid breakaway of the cargo vessel from the superstructure.

2. A system for emplacing an offshore superstructure over a previously installed jacket secured to the sea bottom, the system comprising:

a cargo vessel having a deck and a plurality of parallel-disposed deck-mounted skidways;

a plurality of normally-retracted lifting means nested in each said skidway;

a loading facility for receiving the offshore superstructure and means for skiddingly transferring the superstructure from said loading facility to rest upon and be secured to said deck-mounted skidways;

means operable for moving said cargo vessel into the proximity of the jacket;

means for substantially simultaneously actuating said pluralities of lifting means to extend same and maneuvering said cargo vessel so that the superstructure is above and in alignment with the jacket;

means for transferring the superstructure from said cargo vessel to mate with the jacket; and rebound compensating means for rapidly breaking said lifting means away from the superstructure thereby to compensate for the rebound of said cargo vessel when the mass of the superstructure is accepted by the jacket.

3. The system of claim 2, further comprising means for releasably locking said lifting means in a selected elevated position when said lifting means are extended.

4. The system of claim 2, wherein each said lifting means includes a double-acting piston and said rebound compensating means includes means for rapidly retracting said double-acting pistons of said plurality of lifting means in power-assisted free fall.

5. The system of claim 4, further comprising means operable for docking said cargo vessel adjacent said loading facility and for continuously adjusting the draft of said cargo vessel to a depth sufficient to provide unimpeded skidding transfer of the superstructure from said loading facility to said skidways of said cargo vessel.

6. A variable-draft cargo vessel of the type having a hull, a keel, a deck, and a plurality of separately floodable ballast tanks, wherein the improvement comprises:

a plurality of parallel-disposed skidways mounted to the deck, each said skidway having a top surface;

a plurality of normally retracted lifting means nested within each said skidway and below said skidway top surface;

means for substantially simultaneously actuating said pluralities of lifting means to extend same; and means for rapid retraction of said lifting means from an extended position.

7. The cargo vessel of claim 6, further comprising a pair of bulkheads extending from said deck into said hull below each said skidway and forming a foundation for said skidway.

8. The cargo vessel of claim 7, wherein said plurality of lifting means for each said skidway are installed between said pair of bulkheads, each said lifting means comprising:

a cylinder body assembly;

a sliding piston rod assembly received within said cylinder body assembly; and a rod end cap attached to said piston rod assembly.

9. The cargo vessel of claim 8, wherein said lifting means further comprises:

an annular space between said piston rod assembly and said cylinder body assembly;

a rod-side port in communication with said annular space;

a fluid chamber formed between said cylinder body assembly and a lower end of said piston rod assembly; and a piston-side port in communication with said fluid chamber; and said rapid retraction means comprises:

an accumulator for storing a pressurized fluid, said accumulator hydraulically connected to said rod-side port and said annular space;

first valve means to control flow of the pressurized fluid from said accumulator to said annular space; and second valve means to control flow of the hydraulic fluid out of said chamber, wherein during the rapid retraction of said piston rod assembly from an extended position, said second valve means is opened to permit hydraulic fluid to flow out of said chamber and said first valve means is opened to permit pressurized fluid from said accumulator to fill said annular space and force said piston rod assembly to rapidly retract.

10. The cargo vessel of claim 8, further comprising means for locking said plurality of lifting means at a selected height.

11. The cargo vessel of claim 10, wherein said locking means comprises:

a squeeze bushing positioned around said piston rod assembly; and means to admit a fluid to said squeeze bushing to lock said piston rod at a selected height.

12. The cargo vessel of claim 6, wherein said each said lifting means is capable of extending above said skidway top surface by a distance greater than the height of said skidway.

* * * * *